United States Patent [19]

Johnstonbaugh

[11] Patent Number: 4,615,448

[45] Date of Patent: Oct. 7, 1986

[54] DISPLAY PANEL

[75] Inventor: George S. Johnstonbaugh, New Philadelphia, Ohio

[73] Assignee: Masonite Corporation, Chicago, Ill.

[21] Appl. No.: 781,291

[22] Filed: Sep. 27, 1985

[51] Int. Cl.[4] ..... A47F 5/08

[52] U.S. Cl. ..... 211/94; 211/87; 211/189; 248/220.3

[58] Field of Search ..... 211/87, 94, 189; 52/588, 36, 38, 282, 710, 711; 248/220.3, 220.2, 221.2, 222.2; 40/16, 10 R, 16.2

[56] References Cited

U.S. PATENT DOCUMENTS

| | | | |
|---|---|---|---|
| 3,235,218 | 2/1966 | Graham | 248/220.3 |
| 3,652,048 | 3/1972 | Hartman | 211/90 X |
| 4,434,900 | 3/1984 | Cook | 211/189 |

OTHER PUBLICATIONS

Spacewall International Brochure.

*Primary Examiner*—Robert W. Gibson, Jr.

*Attorney, Agent, or Firm*—Samuel Kurlandsky; Robert M. Didrick; Robert H. Robinson

[57] ABSTRACT

An integral display panel formed of wood composite material provided with a plurality of spaced parallel horizontally extending grooves having a modified T-shaped cross-section, and a substantially sheet-form insert mounted within each of said grooves, each of the inserts having a modified T-shaped cross-section defining a chamber adapted to receive and retain metal or plastic hangers having enlarged base portions which engage the internal wall surfaces of the inserts to hold the hangers on the panels with the hanger arms extending outwardly and normally transverse to the face or surface of a panel, each insert having a web and a pair of flanges arranged in converging relationship, with the outer surface of the converging wall of each flange being provided with a longitudinal bead engaging the surfaces of the groove, each flange terminating in a hook-form lip, the lips directed outwardly with respect to each other and engaging the edges of the grooves of the panel to provide more positive retention and an improved esthetic appearance.

11 Claims, 5 Drawing Figures

DISPLAY PANEL

BACKGROUND OF THE INVENTION

1. Field of the Invention

The present invention relates to wall structures, and more particularly refers to a wall panel which is provided with horizontal or vertical grooves into which base portions of hangers may be readily inserted and readily removed for supporting objects to be displayed.

2. Description of the Prior Art

Many types of display panels have been developed in the past. Some have utilized grooves having J-shaped cross-sections. Such panels had the disadvantage that they had to be properly oriented, since they could not engage a hook if the panel was mounted up-side-down. In U.S. Pat. No. 4,434,900 there is disclosed a display panel having a groove of T-shaped cross-section. This structure has the advantage that it can be mounted with either side up. However it has the disadvantage that when a heavy object is mounted on a supported hanger, the hanger tends to exert so much of a stress on the edges of the groove that they tend to break off. This is especially true when a laminated panel is utilized.

SUMMARY OF THE INVENTION

It is accordingly an object of the invention to provide a display panel which may be utilized with either lateral edge upwardly positioned.

It is a further object of the invention to provide a display panel having grooves laterally disposed for receiving and retaining hangers arranged to support articles to be displayed, wherein the grooves are reinforced to support heavy loads.

It is still further an object to provide groove reinforcements which are securely retained within the grooves and which contribute to the esthetic appearance of the wall structure utilizing the panels.

These and other objects, advantages and functions of the invention will be apparent upon reference to the specification and to the attached drawings illustrating preferred embodiments of the invention, in which like parts are identified by like reference symbols in each of the views.

According to the invention, a display panel is provided having grooves horizontally or vertically arranged and in spaced-apart orientation. The grooves have a symmetrical T-shaped cross-section, and may be formed by machining or any other suitable process. The grooves are lined with an extruded metal or plactic insert having a broad web base and having flanges or sides converging to a narrow slot. The converging flanges or sides are each provided with a longitudinal bead to assist in engaging the walls of the groove. Additionally, in an improved embodiment, hook-form lips which are outwardly directed are provided at the edges of the flanges of the insert for engaging the lips of the supporting groove, and for providing an improved esthetic appearance. The hook-form lips and the lateral beads assist in securely retaining the insert within the groove.

DESCRIPTION OF THE PREFERRED EMBODIMENTS

Figure 1:
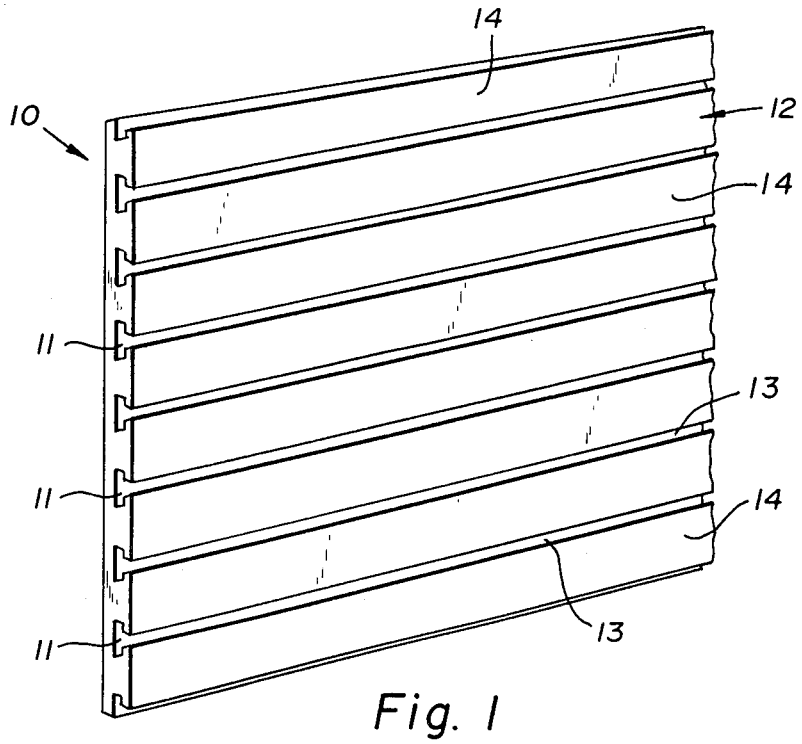
FIG. 1 is a perspective view of a display panel according to the invention.
Figure 4:
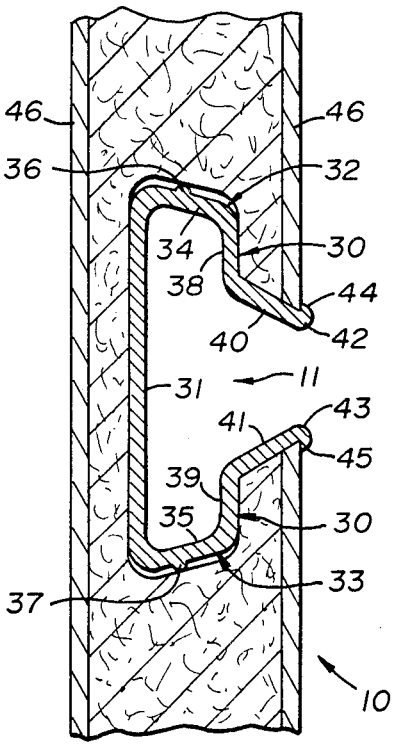
FIG. 4 is a fragmentary view of a display panel similar to that of FIG. 2, but additionally having a surface covering or lamination.
Figure 5:
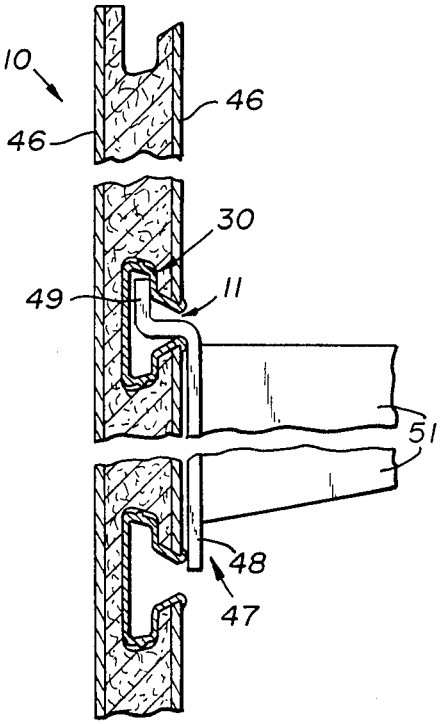
FIG. 5 is a fragmentary cross-sectional view of a display panel showing grooves having an insert mounted therein.

Referring to FIG. 1 a display panel 10 is shown which is preferably formed of wood composite materials such as hardboard, fiberboard, flake board, chipboard, plywood, etc., which materials are relatively low in costs and relatively strong and stable. A preferred embodiment is formed of an integral layer of medium density fiberboard, a material which is formed by compressing a composition of wood fibers and an adhesive material. The panel 10 may nominally be ¾" thick and may be provided with a surface covering 46 as shown in FIGS. 4 and 5. The surface covering may be formed of a vinyl or other plastic material or of a metallic material. If only one side of a panel is to be exposed for display, the decorative surface covering 46 on a back face of the panel may be omitted entirely if desired. However, where the panel is to be used to form a free-standing display wall, it is usually desirable to have decorative surface coverings on both sides or faces of each panel 10.

In accordance with the present invention each panel is provided with a plurality of spaced parallel horizontally extending grooves 11 having a modified T-shaped transverse cross-section. The panel has a face 12 provided with face slots 13 dividing the face 12 into face segments 14.

Figure 2:
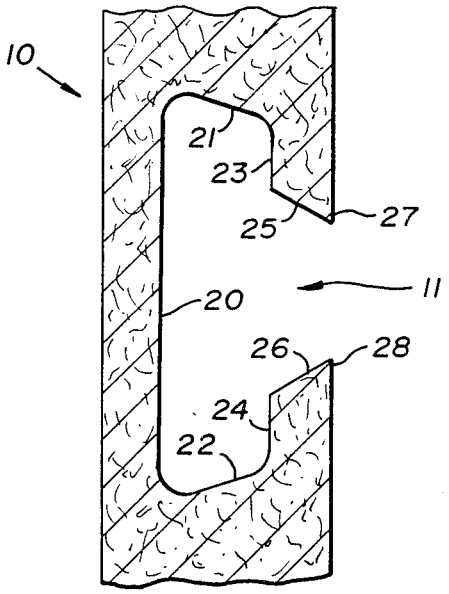
FIG. 2 is a fragmentary cross-sectional view of the display panel of the invention showing one of the grooves which is milled into the panel.

Referring to FIG. 2, a segment of the display panel is shown in cross-section showing the groove 11. The groove 11 is comprised of a plurality of surfaces including a base surface 20 having converging proximal walls 21 and 22, coplanar walls 23 and 24, and converging distal walls 25 and 26 terminating in lips 27 and 28 which may be contoured to refine the edge appearance and to eliminate harsh distracting shadow lines.

Figure 3:
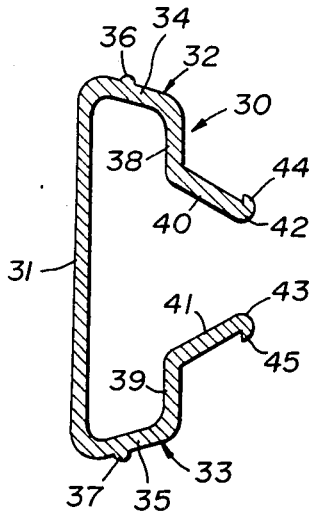
FIG. 3 is a cross-sectional view of a groove insert.

As shown in FIG. 3, and in accordance with the invention, an insert 30 is shown which is adapted to be mounted in each groove 11 to provide the structure defining the groove 11 with increased strength and improved esthetic appearance. The insert 30 may be formed of any of various types of material such as extruded or formed aluminum or plastic material. The insert 30 is comprised of a base web 31 and flanges 32 and 33. The flanges comprise, respectively, converging proximal flange members 34 and 35, each having integral longitudinal beads 36 and 37 provided at their outer surfaces extending along the entire length of the insert. The beads 36 and 37 cooperate with the walls 21 and 22 of the panel 10 to secure the insert 30 within the groove 13. The flanges 32 and 33 also include mutually coplanar flange members 38 and 39, and converging distal flange members 40 and 41 terminating in lips 42 and 43, respectively. The lips 42 and 43 terminate in outwardly-directed hooks or protuberances 44 and 45, respectively, which serve to engage the lips 27 and 28 of the panels 10 for greater strength and rigidity, and additionally for providing a covered margin at the edge of the panel to provide a better esthetic appearance.

Referring to FIG. 4, a fragment of a display panel 10 is shown in cross-section having the groove 11 in which an insert 30 has been mounted. Surface coverings 46 are affixed to either one or both of the face surfaces of the display panel. The surfaces 46 have both a decorative and a protective function, and may be formed of a vinyl or other plastic material, or of metallic elements, such as chromium plated copper, brass or steel.

Referring to FIG. 5, a portion of a panel is shown in cross-section having a hanger 47 with a base portion 48 having a hook 49 mounted into a groove 11. Because of the presence of the inserts 30, greater weights may be placed on the hanger supporting member 51 without breaking or rupturing the panel. The hangers may be made of plastic or metal materials, with the enlarged base portion 48 engaging internal wall surfaces of the grooves to support the hangers on the panel with the hanger arms extending outwardly and normally transverse to the face or surface of the panel.

The display panels of the present invention have several advantages over display panels disclosed in the art. First, the presence of the plastic or metal insert in the groove greatly strengthens the structure and permits greater weights to be placed on the supporting hangers. The presence of the beads on the insert walls improves the engagement between the inserts and walls of the groove and provides a stronger structure. The presence of the outwardly directed hooks or protuberances 44 and 45 also furthers retention of the insert in the groove, and additionally provides a decorative margin at each lip of the panel and covers the lip, thereby improving the esthetic appearance of the panel.

In use, the display panels of the present invention may be mounted against an existing wall or wall support. Alternatively, a plurality of panels may be utilized to form a free-standing wall or arrangement of a plurality of walls. In addition to providing an excellent appearance, the present display panels are useful in providing a means for supporting hangers on which various objects may be mounted.

It is to be understood that the invention is not to be limited to the exact details of construction or operation or materials shown and described, as obvious modifications and equilvalents will be apparent to those skilled in the art.

The invention is claimed as follows:

1. A display panel having a plurality of grooves in horizontal parallel relationship and being vertically spaced-apart, each of said grooves being generally T-shaped and symmetrical about one axis in cross-section, each groove having a substantially flat base and generally converging sidewalls terminating in lips defining a slot of substantially narrower width than that of said base, an insert mounted in each of said grooves, each insert comprising a base web, flanges extending from the sides of said web generally converging toward each other and terminating in lips defining a slot having a width narrower than that of said base web, the outer walls of said insert being in substantial contact engagement with the entire surfaces of said grooves, and wherein the lips of said insert are provided with outwardly hook-like protuberances extending over the lips of said grooves and beyond the outer surface of said panel, whereby portions of hangers may be inserted and retained in said insert for supporting objects to be displayed on said wall.

2. A display panel according to claim 1, wherein a longitudinal bead is provided on the outer side of each of said flanges and engaging the surfaces of said grooves.

3. A display panel according to claim 1, wherein said insert is formed of a plastic material.

4. A display panel according to claim 1, wherein said insert is formed of metal.

5. A display panel according to claim 1, wherein one face thereof if provided with a decorative surface covering.

6. A display panel according to claim 5, wherein said decorative surface covering is formed of a plastic material.

7. A display panel according to claim 5, wherein said decorative surface coating is formed of metal.

8. A display panel according to claim 5, wherein both sides thereof are provided with a decorative surface covering.

9. A display panel according to claim 8, wherein said surface covering is formed of a plastic material.

10. A display panel according to claim 8, wherein said surface covering is formed of metal.

11. A display panel according to claim 1, wherein the flanges of each insert comprise proximal flange members converging towards each other, coplanar flange members directed toward each other, and distal flange members converging toward each other.

* * * * *